United States Patent [19]

Hall

[11] Patent Number: 4,535,559

[45] Date of Patent: Aug. 20, 1985

[54] PORTABLE SHOOTING BENCH

[76] Inventor: Michael F. Hall, 328 NW. 202nd, Seattle, Wash. 98177

[21] Appl. No.: 515,475

[22] Filed: Jul. 20, 1983

[51] Int. Cl.[3] ..... F41C 29/00

[52] U.S. Cl. ..... 42/94

[58] Field of Search ..... 42/94; 89/37 BA

[56] References Cited

U.S. PATENT DOCUMENTS

| | | | |
|---|---|---|---|
| 2,870,683 | 1/1959 | Wilson | 42/94 |
| 3,012,350 | 12/1961 | Wold | 42/94 |
| 3,125,929 | 3/1964 | Peasley | 89/37 BA |
| 3,225,656 | 12/1965 | Flaherty et al. | 42/94 |
| 3,703,046 | 11/1972 | Barone et al. | 42/94 |
| 3,711,984 | 1/1973 | Dyer et al. | 42/94 |

*Primary Examiner*—Charles T. Jordan

*Attorney, Agent, or Firm*—Robert W. Jenny

[57] ABSTRACT

This apparatus enables more accurate firing of rifles and other firearms and is particularly adapted to use for this purpose in hard-to-reach locations and/or over extended continuous periods of use because of its light weight and its compactness when assembled for portage.

16 Claims, 8 Drawing Figures

FIG. 1
PRIOR ART
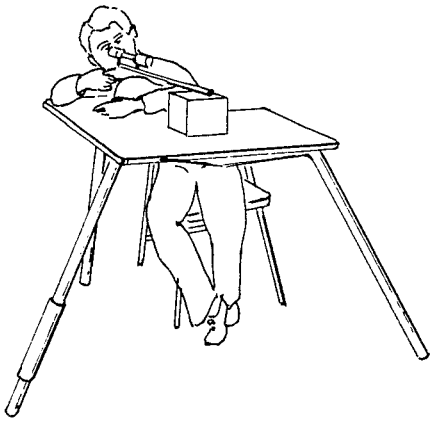
FIG. 2
PRIOR ART
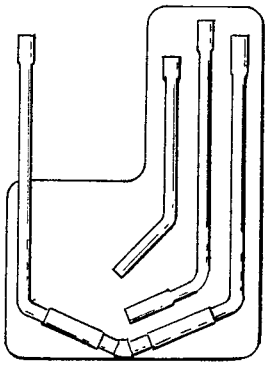
FIG. 3
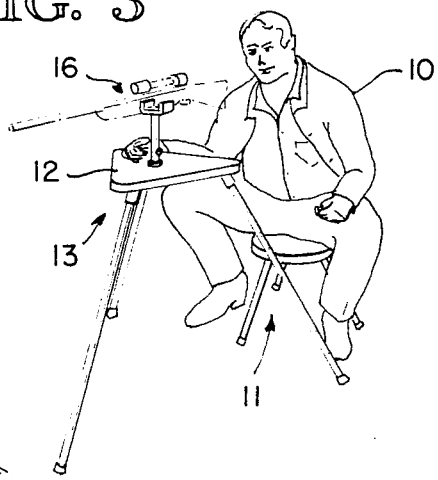
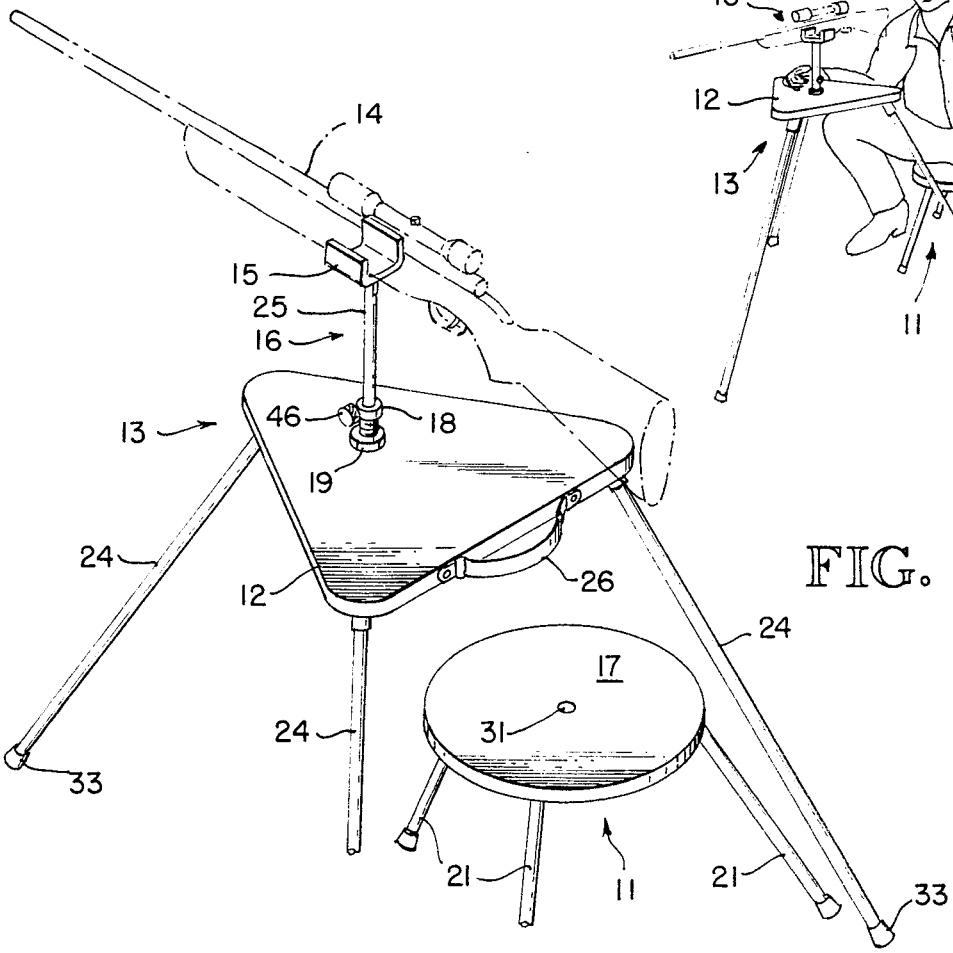
FIG. 4

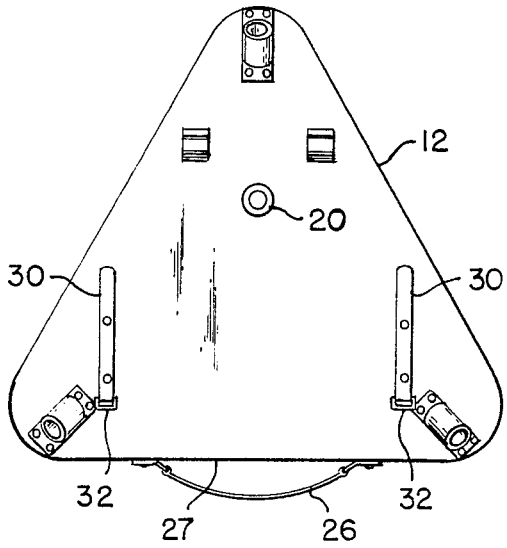
FIG. 5
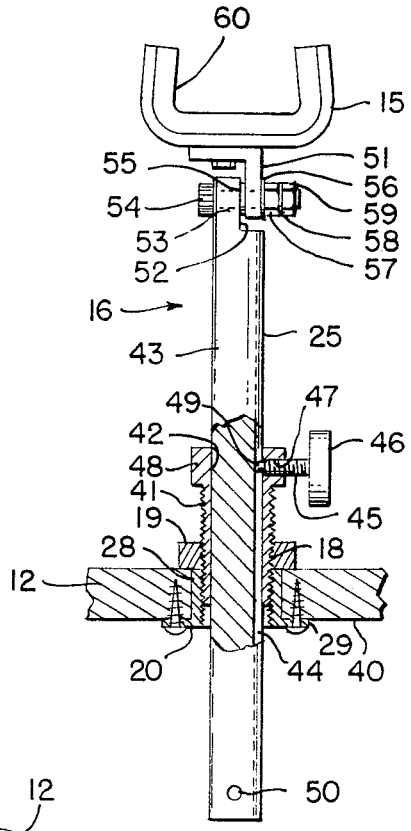
FIG. 6
FIG. 7
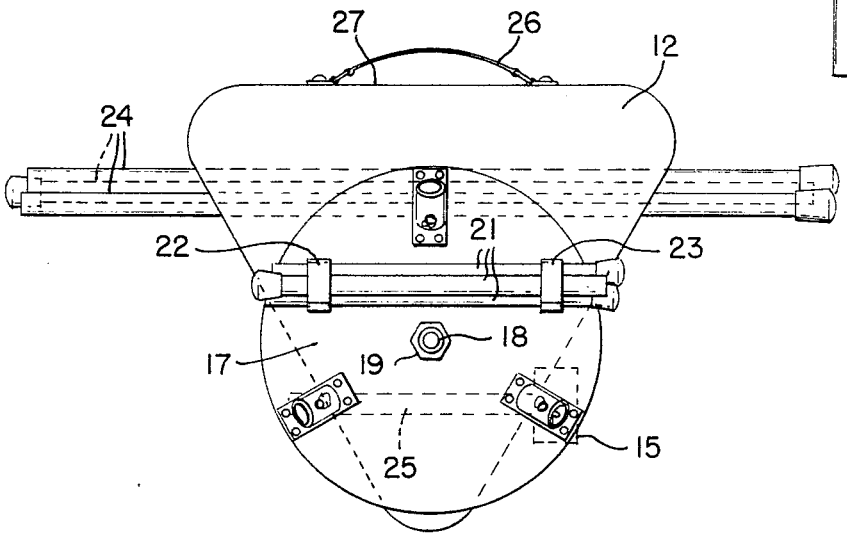

PORTABLE SHOOTING BENCH

BACKGROUND OF THE INVENTION

This invention is in the field of apparatus which makes it possible to shoot firearms with greater accuracy and relates specifically to the shooting of rifles.

The prior art of such apparatus includes a variety of bipods, tripods, rests and the like and more recently apparatus like the Paragon Rifle Bench for which a patent application has been filed and which is marketed by Paragon Activities, P. O. Box 9541, Livonia, Mich., 48150. The Paragon Rifle Bench is a three legged table with an L shaped top and is used with a commercially available folding chair, for example, and a commercially available rifle support as shown in FIG. 1. The legs of the table fold against the lower side of the top for easier transporation of the apparatus.

A second example of prior art is the Phillips Rifle Rest, marketed by Phillips Enterprises Inc., 3600 Sunset Ave., Ocean, N.J. This rest is a foldable, four legged table. The rifle is supported at two points, a padded rest at the fore end of the stock and a shot bag directly under the stock just behind the hand grip. There is no provision for seating the shooter and no provision for shooting from the prone position.

A third prior art article is the Portable Shooting Bench marketed by Joe Hall's Shooting Products, Inc., Dept. AH, 443 Wells Rd., Doylestown, Pa., 18901. This bench is four legged, provides a single rest point for the rifle near the forward end of the stock, and includes a seat directly attached to the bench. An optional gun rest is available and sandbags are useful for more precise shooting.

A fourth prior art apparatus is the Tour De Force Shooting Bench, made by A&A Design and Manufacturing, 361 S.W. K St., Dept. HM, Grants Pass, OR 97526. This apparatus comprises a four legged bench with a single legged table supported from the bench. The rifle rests on a single, padded rest under the forward end of the stock, with the butt supported by the shooter.

A fifth prior art bench is marketed by Original Products, Inc., Rt. 5, Box 484, Dept. S.I., Detroit Lakes, MN 56501. The seat and table top of this apparatus are attached to a single, foldable framework support and it is used with any commercially available padded rest.

In addition a variety of monopod, bipod and tripod rifle rests are available. These, however, are not comparable to bench rests which provide various degrees of support for the shooter's elbows in addition to the support provided by attached seats or separate seats.

The need for such equipment arises in good part because the accuracy and range of modern rifles and the sighting equipment is such that optimum marksmanship cannot be achieved when the rifle is supported and aimed totally or even partly by a person because the rifle cannot be held steady enough. The most precise way to shoot a rifle is from a fixed bench and stool. Atop the bench the shooter has any number of sang bags. The forend and butt of the rifle stock are pushed down into sand bags and the sand bags form around the two contact points. This technique eliminates virtually all human interference with the steady pointing of the rifle. However, this technique is practical only at an established shooting range and not at all useful in the field because the bench is very heavy in construction, requires level ground, requires a plurality of 6 to 8 lb. sand bags and does not allow for a variety of target locations or elevations. The bench is fixed to shoot at a fixed target and the target location never changes. It has been found that with prior art equipment that is portable two handed contact with the rifle is required during the time of firing and such contact has a strong tendency to degrade the accuracy of the rifle and its sighting attachments. This difficulty is obviously aggravated if the firearm must be held and aimed for long periods of time as is necessary, for example, in shooting varmints out of necessity or for sport shooting. Such shooting is frequently done at near maximum range for a combination of reasons including increasing the challenge of sport shooting and allowing for the wariness of the game being hunted.

As can be readily understood, the type of shooting described may be done in areas and on terrains which are difficult to reach even on foot. It is therefore important that the equipment be easy to transport in terms of its size and weight, particularly in relation to its effectiveness in use in terms of stability and rigidity.

It is also quite likely that the sites chosen for shooting in various areas and terrains will not be level or nearly level. It is therefore essential to the effectiveness of the equipment that it be stable and steady in use on sites which are uneven or unlevel or both.

In view of the problem described and the described prior art, it is considered clear that the prior art equipment does not adequately solve the problem of achieving the desired optimum accuracy. It is difficult to stabilize four legged equipment on terrain which is at all uneven. Furthermore, under the best conditions, with a seat attached to the bench any shifting of the shooter's position is quite likely to affect accuracy adversely. On the other hand, with the prior art equipment without an attached seat, the shooter must either sit on the ground when shooting or be encumbered with some type of separate seat when carrying the equipment.

Also, in the prior art equipment support and stabilization of the rifle requires sand bags, firm contact with the shooter or both. Carrying and using sandbags is a definite inconvenience and they do not provide reliable stability in the field. The requirement for firm contact with the shooter makes accuracy dependent on the steadiness of the shooter and this has a deleterious effect on accuracy, particularly when shooting for any extended period of time.

Also, the prior art equipment does not provide a good combination of sturdiness and stability relative to weight and to compactness for transport. The sturdy equipment is heavy (i.e. approximately 40 pounds) and is cumbersome to carry. The lighter equipment tends to be flexible and not provide a stable, steady rest. In view of the above it can be understood that the problem leading to the subject invention was the need for apparatus which is easily transported to and from difficult to reach locations and enables optimum accuracy of firearms over extended periods of time on terrain which is possibly uneven and/or unlevel.

Therefore, the objectives of this invention are to provide apparatus which improves the possibilities of achieving the best accuracy obtainable from given shooting equipment, with the apparatus providing a stable, solid support during use, allowing a minimum of contact with the rifle during the time of firing, capable of compact assembly for transportation, and light in weight relative to the stability and solidity of the support provided. The objective of allowing a minimum of contact with the rifle during the time of firing inherently includes the objectives that the rifle support facilitate aiming and that all adjustments for aiming the rifle be self locking or lockable and that the rifle be held at its balance point. It is a further objective that the above cited objectives be acheivable on uneven terrain, in hard to reach areas and environments and over extended continuous periods of time.

SUMMARY OF THE INVENTION

The invention comprises a three legged table and a three legged stool. The planform of the table top is an isosceles triangle with radiused corners. Rifle support apparatus is mounted on the table top near the apex of the table top planform. The support apparatus supports and holds the rifle in the vicinity of the center of gravity of the rifle and is position adjustable and lockable in terms of height of the rifle from the table top, azimuth angle and elevation angle. In operation the shooter sits on the stool at the base end of the table planform, adjusts the support apparatus to aim the rifle as desired and the only required contact with the rifle at the time of firing is support of the butt of the stock by the shooter's shoulder and pulling of the trigger. The heights of the stool and rest are such that when the shooter is sitting in the shooting position the shooter's thighs are essentially horizontal. This positioning has been found to be critical for balance. For right handed shooters, for example, the right elbow is supported on the right knee which is stable because the thigh is horizontal. In effect the shooter has a maximum of balance needed for the physical contribution the shooter must provide to achieve accuracy. The support apparatus compensates to a considerable extent for the effects of the phenomenon known as barrel whip and absorbs some of the recoil. For transportation, the legs of the table and stool are removed, the table top and stool top are fastened face to face by some of the parts of the rifle support apparatus and the legs and remaining support apparatus subassembly are fastened to the exposed surfaces of the table and seat tops by in-place fastening means. The base edge of the table top is fitted with a handle for carrying the compact assembly of the dismantled apparatus.

BRIEF DESCRIPTION OF THE DRAWINGS

FIG. 1 is a perspective view of typical prior art for this invention, showing the prior art apparatus in use.

FIG. 2 shows the prior art apparatus ready for transport.

FIG. 3 is a perspective view of the subject invention in use.

FIG. 4 is a closer view of the subject invention, set up but not in use.

FIG. 5 is a bottom view of the table top, showing the planform and location of the support legs and the rifle support apparatus.

FIG. 6 is a sectional view of the rifle support apparatus.

FIG. 7 shows the apparatus assembled for transport.

DETAILED DESCRIPTION OF A PREFERRED EMBODIMENT OF THE INVENTION

Figure 8:
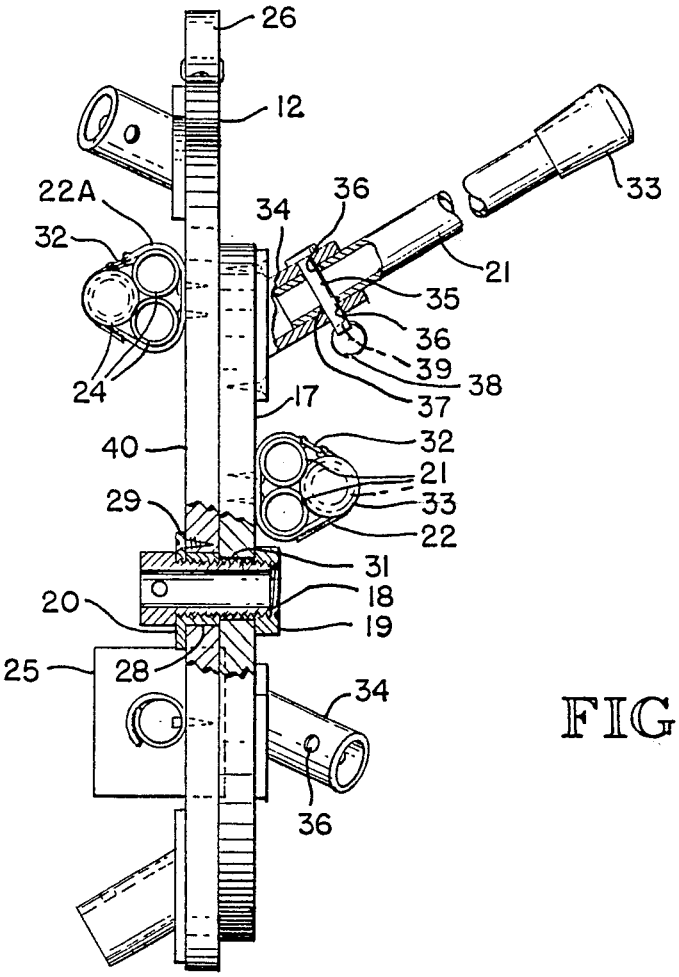
FIG. 8 is a sectional view of the apparatus assembled for transport, including a sectional view of a typical leg and leg attachment fitting.

The overall concept of the subject invention can be best explained with reference to FIGS. 3 and 7. In FIG. 3 the shooter 10 is seated on stool 11 at the base end of table top 12 of table 13. Rifle 14 is supported and held in U shaped bracket 15 which is part of the rifle support apparatus 16. The advantages of using 3 legs on the stool and on the table are well known, i.e. stability is provided on uneven surfaces and the stool and table tops can be positioned relatively level on unlevel terrain by removing material from under only one each of the legs of the stool and table. The height of the stool and the relatively greater height of the table have been determined as providing an optimum compromise among compactness of the apparatus for transport, overall simplicity of the apparatus and comfortable use for a wide range of heights of users.

In FIG. 7 the apparatus has been dismantled from the use configuration shown in FIG. 3 and re-assembled for transportation. Table top 12 is fastened face to face to stool seat 17 by fitting 18 and nut 19 in combination with flange bushing 20 (not visible in this view). Fitting 18 and nut 19 are parts of the rifle support apparatus described in full detail below. Stool legs 21 are attached to the stool seat 17 by straps 22 and 23 which are attached by suitable fasteners well known in the art to the under side of seat 17. Table legs 24 are similarly fastened to the exposed underside of the table top 12. Subassembly 25 of the rifle support assembly 16 is also attached by straps to the exposed surface of top 12 and the entire assembly is carried by handle 26 attached to base edge 27 of table top 12. The planform of the table top is defined as an isosceles triangle with raduised corners. The triangle may be equilateral. The edge of the table which forms the base of the isosceles triangle (or a selected side of an equilateral triangle) is designated as the base of the table and is fitted with a handle for carrying the apparatus when it is assembled for transport. The rifle support apparatus, which may be designated as the turret, is located on a centerline which bisects the triangle and the base and relatively closer to the corner opposite the base than to the base. The location is a compromise among keeping the table size small, providing ample room for the shooter's arms and elbows and having the rifle weight well inside the triangle defined by the ends of the legs in contact with the ground. The range of the location along the axis is between midway from the base to $\frac{3}{4}$ of the distance from the base to the apex of the triangular planform (i.e. the intersection of the sides of the triangle without the apex corner being radiused).

FIG. 8, the sectional view of the apparatus assembled for transport, illustrates the assembly in more detail, particularly in regard to the attachment of the table top and stool seat face to face by fitting 18, nut 19 and flanged bushing 20. Bushing 20 is installed in hole 28 in the table top 12 with the flange 29 against the lower surface 40 of the table top and held in place with wood screws. Fitting 18 fits closely in hole 31 in the center of stool seat 17. The attachment of the legs for transport is illustrated in more detail. For the stool legs 21, strap 22 is fastened by wood screws and washers shown in phantom, to stool seat 17. Similarly for the table legs 24, straps 22A (one only shown) are fastened by wood screws and washers to table top 12. Subassembly 25 of the rifle support apparatus is also strapped to the table top for transport, in the location indicated in the drawing. The straps shown are made of Velcro material with the self adhering surface of the Velcro facing away from the strapped items. With this arrangement one end of each strap is fitted with a sewn on buckle loop 32 through which the other end of each strap is inserted and then turned back onto itself and adhered in that position to secure the strap.

All the legs are tubular and fitted with elastomeric material tips 33 similar to those used on crutches. Still referring to FIG. 8, each leg fits into a socket fitting 34 and is retained in place by a clevis pin 35 fitted through hole 36 in the fitting and 37 in the leg.

The clevis pins are retained by any commercially available method, the one shown comprising a spring ring 38 similar to a key ring fitted into hole 39. Each fitting 34 is attached with wood screws, as illustrated also in FIG. 5. As is well known in the design of three legged tables and stools, the fittings are designed and positioned so that the legs angle outwardly and downwardly to provide enough separation between the lower ends of the legs for amply stable support of the table and stool.

FIG. 6 is a sectional view of the rifle support assembly 16, showing its details and installation on table top 12. As previously stated, flanged bushing 20 is inserted into hole 28 in the table top with the flange 29 against the bottom face 40 of the table top. The bushing is held in place with wood screws through the flange. The inside diameter of the bushing is threaded and fitting 18, with nut 19 threaded onto its threaded shank 41, is threaded into the bushing. Subassembly 25 slides into bore 42 of fitting 18. The cylindrical shaft 43 of subassembly 25 has a keyway 44 running its full length. Threaded shank 45 of knobscrew 46 is threaded into tapped hole 47 in hub 48 of fitting 18. The end of shank 45 has a reduced diameter extension 49 which engages keyway 44 to prevent subassembly 25 from rotating with respect to fitting 18. Tightening the knobscrew 46 against shaft 43 prevents linear motion of subassembly 25 up or down in fitting 18. Correspondingly, the linear position of apparatus 16 up or down is adjusted by loosening screw 46, adjusting the position of apparatus 16 and retightening screw 46.

When subassembly 25 is strapped to table top 12 for transport, knobscrew 46 is threaded into tapped hole 50 for safekeeping during transport and/or storage of the apparatus.

Further describing the rifle support apparatus, U shaped bracket 15 is attached to angle bracket 51 which is in turn attached to the flat face 52 of the semicylindrical end portion 53 of shaft 43. This attachment is made with screw 54, friction washer 55, lockwasher 56, nut 57, lockwasher 58 and lock nut 59. With appropriate tightening of nut 57, bracket 15 is rotatable about the axis of screw 54 but with sufficient resistance from the friction washer 55 to keep bracket 15 in whatever position it is set to for adjustment of the elevation angle of the position of a rifle set into bracket 15. Locknut 49 and lockwashers 56 and 58 serve to preserve the appropriate tightening of nut 57.

Bracket 15 is lined with energy absorbing elastomeric padding 60. Bracket 15, in a preferred form, is made of composite material and is springy. The sides of the bracket flex outwardly from the base when a rifle is inserted. In a preferred form the bracket is made of four layers of plastic impregnated $1\frac{1}{2}$ ounce fibreglass matting cloth. The elasticity of the padding and the springiness of the bracket permit firm accomodation and holding of a variety of types of rifles without adjustment of the support apparatus. The padding is essential to the compensation provided by the support apparatus for the effects of barrel whip. The padding is held in place by adhesive. It has been determined that Esolite PE 308 foam about 5/16 thick, a product of Uniroyal, provides excellent shock absorbing capability and helps alleviate the barrel whip and associated effects which occur when a rifle is fired.

Use of the invention is straightforward. Upon arrival at the site selected for shooting, with the invention assembled for transportation, all the legs and subassembly 25 are unstrapped from the table and stool tops. Nut 19 is removed and the stool seat is separated from the table top. Then the table and stool legs are installed by removal of the clevis pins in each leg attachment fitting, inserting the legs and reinserting the clevis pins. Fitting 18 is threaded out of bushing 20, nut 19 is threaded onto fitting 18 and then fitting 18 is again threaded into bushing 20 from the top face of the table top. Knob screw 46 is threaded out of hole 50 in shaft 43 and threaded part way into hole 47 in fitting 18. Then subassembly 25 is inserted into the bore of fitting 18 and oriented so that tip 49 of knobscrew 46 will engage keyway 44 of shaft 43. A height for bracket 15 above the table top is selected and knobscrew 46 tightened to secure the subassembly in the selected position.

The table and stool can then be placed in desired locations and leveled if necessary by appropriate displacement or addition of material under one or more legs. A rifle can then be placed into foam lined bracket 15 with the balance point (center of gravity) of the rifle centered closely over the center of the bottom of the bracket. With the rifle so positioned, and in combination with the springiness of bracket 15 and the elasticity of the foam padding 60, the rifle can be fired by supporting the butt of the stock by the shooter's shoulder and pulling the trigger.

To aim the rifle, elevation angle is adjusted by rotating bracket 15 with the rifle in place about screw 54 and azimuth angle is adjusted by turning nut 19 counterclockwise until it is just free of contact with the table top, turning the rifle and rifle support assembly about the axis of shaft 43 with the relative displacement occurring between the threads of fitting 18 and bushing 19, and then tightening nut 19 against the table top to lock the rifle at the desired azimuth angle.

The apparatus is well adapted for use for shooting from the prone position, using just the table top with the rifle support assembly installed. The table top alone can also be used on any convenient surface such as the hood of a vehicle, particularly if the added height is needed to see and shoot over rocks, ground cover or the like. The apparatus is also well adapted for use with firearms such as pistols and revolvers. However, it is recommended that a conventional rest be used with revolvers instead of the support assembly because of possible damage to the padding in the bracket by cylinder blast.

It is considered to be clear from the preceding description and discussion that the subject invention meets the objectives cited and therefore solves the problems leading to its conception, overcoming the shortcomings of known prior art apparatus.

In use, the table and stool are solidly stable and the shooter is comfortably seated. The shooter can shift his or her weight without interfering with firing accuracy. The rifle is adequately supported without contact by the shooter so that only minimum contact is required for shooting and therefore there is minimum negative effect on the accuracy due to contact by the shooter. No loose equipment such as sandbags or auxilliary rests is required. The apparatus, when assembled for transport, is compact, with no loose or separate parts and includes the stool. Also, the weight of the apparatus is low because of the conservative size of the table and stool tops and the reduced weight of fittings and legs enabled by detaching rather than folding the legs. Detaching the legs also enables more compact assembly for transport than folding the legs could, relative to the length of the legs and the stability of the apparatus in use.

It will be obvious to those skilled in the art that various alternate implementations of the invention are possible, differing in various ways from the preferred embodiment described. The scope of the subject invention is not to be considered limited to the embodiment described but only by the scope of the appended claims.

I claim:

1. Apparatus for optimizing the accuracy of shooting of rifles, comprising:

a rifle support apparatus comprising:

means for mounting said support apparatus, a bracket, a table having a top, said top having a hole for accomodation of said means for mounting said support apparatus, said hole having an axis normal to said top and a center, said means for mounting said support apparatus comprising:

a plurality of parts and a subassembly of some of said plurality of parts, said subassembly including a shaft having a first, longitudinal axis and a hole having a second axis normal to said first axis, said means for mounting said support apparatus further comprising:

means for adjusting the position of said shaft linearly along said first axis and means for adjusting the position of said shaft rotationally about said first axis, said bracket being pivotally attached to said shaft at said hole having said second axis, and being adjustable about said second axis, said means for mounting said support apparatus being attached in said hole, in said top of said table with said first axis coincident with said axis of said hole in said top of said table, whereby the position of a rifle inserted into and supported by said apparatus is rotationally adjustable about said second axis of said shaft, linearly adjustable along said first axis normal to said top of said table and rotationally adjustable about said first axis.

2. The apparatus of claim 1, in which, said rifle holding bracket is U shaped, having:

a base portion having first and second edges, a first side extending essentially at a right angle to said base from said first edge and a second side extending essentially at a right angle to said base from said second edge, said bracket being springy so that said first and second sides flex in angular position with respect to said base, said bracket being lined with energy absorbing elastomeric padding, whereby said bracket firmly holds any of a variety of types of rifles and absorbs some of the energy imparted to a held rifle when the rifle is fired.

3. The apparatus of claim 1 wherein:

said top of said table has a top surface and an undersurface, said table has detachable legs and means for attaching said legs to said undersurface in orientation for use of said table and means for attaching said legs to said undersurface in orientation for transport of said apparatus and means for attaching said subassembly to said underside of said top of said table in orientation for transport of said apparatus, said apparatus further comprising:

a stool, further comprising:

a top having a top surface and an undersurface and means for attaching legs to said stool undersurface in orientation for use of said apparatus and means for attaching said stool legs to said stool undersurface in orientation for transport of said apparatus and a hole having an axis normal to said top of said stool, said top of said table being attachable to said stool by some of said plurality of parts inserted through said hole in said top of said table and said hole in said top of said stool, with said top surface of said top of said table in contact with said top surface of said top of said stool, whereby, with said top of said table attached to said top of said stool with said top surface of said top of said table in contact with said top surface of said top of said stool and said legs of said table fastened to said undersurface of said top of said table by said means for attaching said legs to said undersurface in orientation for transport of said apparatus and said subassembly attached to said undersurface of said top of said table by said means for attaching said subassembly to said underside of said top of said table in orientation for transport of said apparatus, and said legs of said stool fastened to said undersurface of said top of said stool by said means for attaching said legs to said undersurface in orientation for transport of said apparatus, said apparatus is completely and compactly assembled for transport.

4. The apparatus of claim 3 in which said rifle holding bracket is U shaped, having:

a base portion having first and second edges, a first side extending essentially at a right angle to said base from said first edge and a second side extending essentially at a right angle to said base from said second edge, said bracket being springy so that said first and second sides flex in angular position with respect to said base, said bracket being lined with energy absorbing elastomeric padding, whereby said bracket firmly holds any of a variety of types of rifles and absorbs some of the energy imparted to a held rifle when the rifle is fired.

5. The apparatus of claim 3, in which:

said plurality of parts, including a subassembly, of said rifle support means comprises:

a rifle holding bracket, an L shaped angle bracket, a bolt with associated nuts, lockwashers and friction washer
a shaft having:
a longitudinal axis,
a first end,
a second end,
a keyway extending the length of said shaft,
a hole near said first end,
said hole having an axis normal to and intersecting said longitudinal axis,
a tapped hole near said second end,
said tapped hole having an axis normal to and intersecting said longitudinal axis,
a fitting having
a bore,
a cylindrical head portion and
a cylindrical shank portion, having a threaded outer surface,
said cylindrical head portion and cylindrical shank portions being integrated and having a common axis,
said head portion having a tapped hole having its axis normal to said common axis and intersecting it,
a nut threaded to fit said threaded outer surface of said shank portion,
a bushing having an end, a bore threaded to fit said threaded shank portion and a flange extending outwardly from said end,
a knobscrew having first and second ends and having a knob at said first end and a keyway engaging extension at said second end,
said bushing being installed in said hole for accomodation of said rifle support apparatus,
said nut being threaded onto said cylindrical shank portion of said fitting,
said cylindrical shank portion being threaded into said bore in said bushing,
said shaft being inserted into said bore of said fitting,
said threaded shank of said knobscrew being threaded into said tapped hole in said head portion of said fitting with said keyway engaging extension engaging said keyway of said shaft,
said L shaped angle bracket being fastened to said shaft at said hole near said first end by said bolt, nuts, lockwashers and friction washer,
said rifle holding bracket being fastened to said L shaped bracket,
said subassembly comprising said rifle holding bracket, said shaft, said L shaped angle bracket and said bolt with associated nuts, lockwashers and friction washer,
whereby the position of a rifle held in said rifle holding bracket is adjustable about said longitudinal axis with relative motion between said threaded bore in said bushing and said threaded shank portion of said fitting, and
the position of a rifle held in said rifle holding bracket is adjustable about said axis of said hole near said first end of said shaft, and
the position of a rifle held in said rifle holding bracket is adjustable linearly along said longitudinal axis of said shaft.

6. The apparatus of claim 5, in which
said some of said plurality of parts comprises:
said bushing,
said fitting and
said nut,
whereby said top of said table is attached to said top of said stool by:
threading said threaded shank of said fitting into said bushing from said undersurface of said table until said head portion contacts said undersurface and said shank extends beyond said top surface of said top of said table,
inserting said threaded shank through said hole in said top of said stool until said top surface of said top of said table is against said top surface of said top of said stool and
threading said nut onto said threaded shank of said fitting to secure said top of said table against said top of said stool,
whereby with the additional step of threading said knobscrew into said tapped hole in said second end of said shaft, said apparatus is completely and compactly assembled for transport.

7. The apparatus of claim 4, in which:
said plurality of parts, including a subassembly, of said rifle support means comprises:
a rifle holding bracket,
an L shaped angle bracket,
a bolt with associated nuts, lockwashers and friction washer
a shaft having:
a longitudinal axis,
a first end,
a second end,
a keyway extending the length of said shaft,
a hole near said first end,
said hole having an axis normal to and intersecting said longitudinal axis,
a tapped hole near said second end,
said tapped hole having an axis normal to and intersecting said longitudinal axis,
a fitting bore,
a bore,
a cylindrical head portion and
a cylindrical shank portion, having a threaded outer surface,
said cylindrical head portion and cylindrical shank portions being integrated
and having a common axis,
said head portion having a tapped hole having its axis normal to said common axis and intersecting it,
a nut threaded to fit said threaded outer surface of said shank portion,
a bushing having an end, a bore threaded to fit said threaded shank portion and a flange extending outwardly from said end,
a knobscrew having first and second ends and having a knob at said first end and a keyway engaging extension at said second end,
said bushing being installed in said hole for accomodation of said rifle support apparatus,
said nut being threaded onto said cylindrical shank portion of said fitting,
said cylindrical shank portion being threaded into said bore in said bushing,
said shaft being inserted into said bore of said fitting,
said threaded shank of said knobscrew being threaded into said tapped hole in said head portion of said fitting with said keyway engaging extension engaging said keyway of said shaft,
said L shaped angle bracket being fastened to said shaft at said hole near said first end by end bolt, nuts, lockwashers and friction washer, said rifle holding bracket being fastened to said L shaped bracket, said subassembly comprising said rifle holding bracket, said shaft, said L shaped angle bracket and said bolt with associated nuts, lockwashers and friction washer, whereby the position of a rifle held in said rifle holding bracket is adjustable about said longitudinal axis with relative motion between said threaded bore in said bushing and said threaded shank portion of said fitting, and the position of a rifle held in said rifle holding bracket is adjustable about said axis of said hole near said first end of said shaft, and the position of a rifle held in said rifle holding bracket is adjustable linearly along said longitudinal axis of said shaft.

8. The apparatus of claim 7, in which said some of said plurality of parts comprises:

said bushing, said fitting and said nut, whereby said top of said table is attached to said top of said stool by:

threading said threaded shank of said fitting into said bushing from said under surface of said table until said head portion contacts said undersurface and said shank extends beyond said top surface of said top of said table, inserting said threaded shank through said hole in said top of said stool until said top surface of said top of said table is against said top surface of said top of said stool and threading said nut onto said threaded shank of said fitting to secure said top of said table against said top of said stool, and whereby with the additional step of threading said knobscrew into said tapped hole in said second end of said shaft, said apparatus is completely and compactly assembled for transport.

9. The apparatus of claim 1, in which said top of said table in plan view has the shape of an isosceles triangle with radiused corners, said triangle having a base, an apex, said apex being a distance from said base, and an axis bisecting said base and perpendicular to it, said center of said hole for accomodation of said means for mounting said support apparatus located on said axis in a position along said axis in the range from equidistant between said base and said apex to $\frac{3}{4}$ of said distance from said base to said apex and closer to said apex than to said base.

10. The apparatus of claim 2, in which said top of said table in plan view has the shape of an isosceles triangle with radiused corners, said triangle having a base, an apex, said apex being a distance from said base, and an axis bisecting said base and perpendicular to it, said center of said hole for accomodation of said means for mounting said support apparatus located on said axis in a position along said axis in the range from equidistant between said base and said apex to $\frac{3}{4}$ of said distance from said base to said apex and closer to said apex than to said base.

11. The apparatus of claim 3, in which said top of said table in plan view has the shape of an isosceles triangle with radiused corners, said triangle having a base, an apex, said apex being a distance from said base, and an axis bisecting said base and perpendicular to it, said center of said hole for accomodation of said means for mounting said support apparatus located on said axis in a position along said axis in the range from equidistant between said base and said apex to $\frac{3}{4}$ of said distance from said base to said apex and closer to said apex than to said base.

12. The apparatus of claim 4, in which said top of said table in plan view has the shape of an isosceles triangle with radiused corners, said triangle having a base, an apex, said apex being a distance from said base, and an axis bisecting said base and perpendicular to it, said center of said hole for accomodation of said means for mounting said support apparatus located on said axis in a position along said axis in the range from equidistant between said base and said apex to $\frac{3}{4}$ of said distance from said base to said apex and closer to said apex than to said base.

13. The apparatus of claim 5, in which said top of said table in plan view has the shape of an isosceles triangle with radiused corners, said triangle having a base, an apex, said apex being a distance from said base, and an axis bisecting said base and perpendicular to it, said center of said hole for accomodation of said means for mounting said support apparatus located on said axis in a position along said axis in the range from equidistant between said base and said apex to $\frac{3}{4}$ of said distance from said base to said apex and closer to said apex than to said base.

14. The apparatus of claim 6, in which said top of said table in plan view has the shape of an isosceles triangle with radiused corners, said triangle having a base, an apex, said apex being a distance from said base, and an axis bisecting said base and perpendicular to it, said center of said hole for accomodation of said means for mounting said support apparatus located on said axis in a position along said axis in the range from equidistant between said base and said apex to $\frac{3}{4}$ of said distance from said base to said apex and closer to said apex than to said base.

15. The apparatus of claim 7, in which said top of said table in plan view has the shape of an isosceles triangle with radiused corners, said triangle having a base, an apex, said apex being a distance from said base, and an axis bisecting said base and perpendicular to it, said center of said hole for accomodation of said means for mounting said support apparatus located on said axis in a position along said axis in the range from equidistant between said base and said apex to $\frac{3}{4}$ of said distance from said base to said apex and closer to said apex than to said base.

16. The apparatus of claim 8, in which said top of said table in plan view has the shape of an isosceles triangle with radiused corners, said triangle having a base, an apex, said apex being a distance from said base, and an axis bisecting said base and perpendicular to it, said center of said hole for accomodation of said means for mounting said support apparatus located on said axis in a position along said axis in the range from equidistant between said base and said apex to $\frac{3}{4}$ of said distance from said base to said apex and closer to said apex than to said base.

* * * * *